US005334101A

United States Patent [19]

McDermott

[11] Patent Number: 5,334,101

[45] Date of Patent: Aug. 2, 1994

[54] CONNECTOR FOR DETACHABLE BILLIARD CUE

[75] Inventor: James D. McDermott, Germantown, Wis.

[73] Assignee: McDermott Cue Manufacturing, Inc., Menomonee Falls, Wis.

[21] Appl. No.: 68,544

[22] Filed: May 27, 1993

[51] Int. Cl.[5] ..... A63D 15/08

[52] U.S. Cl. ..... 473/44; 403/296

[58] Field of Search ..... 273/68–70; 403/296

[56] References Cited

U.S. PATENT DOCUMENTS

| | | | |
|---|---|---|---|
| 1,562,372 | 11/1925 | Sheldon | 403/296 |
| 1,679,073 | 7/1928 | Carmichael . | |
| 3,170,691 | 2/1965 | Pritchard | 403/296 |
| 3,232,613 | 2/1966 | Laube | 273/68 |
| 3,489,437 | 1/1970 | Duret . | |
| 4,231,574 | 11/1980 | Williams | 273/68 |
| 4,314,575 | 2/1982 | Kuo . | |
| 4,718,671 | 1/1988 | Desmond et al. . | |
| 4,790,208 | 12/1988 | Johnson . | |

FOREIGN PATENT DOCUMENTS

| | | | |
|---|---|---|---|
| 2192800 | 1/1988 | United Kingdom | 273/68 |
| 2222091 | 2/1990 | United Kingdom | 273/68 |
| 2226251 | 6/1990 | United Kingdom | 273/68 |
| 2226251A | 6/1990 | United Kingdom . | |
| 2246302 | 1/1992 | United Kingdom | 273/68 |

*Primary Examiner*—Mark S. Graham

*Attorney, Agent, or Firm*—Whyte Hirschboeck Dudek

[57] ABSTRACT

A cue connector for detachably joining a shaft section and a butt section of a billiard or pool cue. The connector comprises a one-piece, integrally formed fitting in threaded securement to a threaded extension of the butt section which includes a threaded pin for manual detachable threading engagement with the threaded bore of an externally threaded insert fitting arranged for threaded securement with a threaded re-entrant bore of the shaft section.

8 Claims, 2 Drawing Sheets

CONNECTOR FOR DETACHABLE BILLIARD CUE

BACKGROUND OF THE INVENTION

This invention relates to improvements in a two piece detachable, jointed billiard cue.

It is usual for the serious billiard or pool player to use a cue which may be detachable into two parts. This facilitates the portability of the cue, which may be more than five feet in length.

There have been previous suggestions for detachably joining cue sections. Several versions included joining male and female screwthreaded cue sections. Also, there have been disclosed cue connectors using a push-fit connection. A push-fit connection, although readily permitting attachment and detachment of the cue sections, has been found to lack the desired rigidity and close fit between the mating sections. Also, such a connection tends to allow one part to rotate about its longitudinal axis relative to the other part. Examples of push-fit fittings or connectors are shown in U.K. Patent 2,219,946 published Dec. 28, 1989 and U.S. Pat. No. 1,505,609 granted Aug. 19, 1924 to Seeman et al.

Examples of screwthreaded connector means for billiard cues are disclosed in U.S. Pat. Nos. 3,462,147, 3,368,271, and 3,436,079.

Although these prior art devices have found satisfactory application, they have not presented the desired "feel" of an integrally formed, single-piece cue.

It is the principal object of the present invention to provide a connector for a billiard cue or the like, which cue has a pair of jointed, detachable sections, which when joined together provide a billiard player with the feel of a single-piece cue. It is another object of the invention to provide a one-piece butt joint which is a solid mass that transmits vibration (feel) to the shooter's hand similar to a solid one-piece wood cue.

A secondary object of the present invention is to provide a connector joint and shaft insert, individually machined in a single setup for maintaining precise concentricity of mating threads and location of diameters and squareness of facing members.

A further object of the present invention is to provide a connector for a detachable, jointed pool cue manufactured for higher accuracy of machined components than in the case of previous designs.

SUMMARY OF THE INVENTION

A preferred embodiment of the invention presents a connector for a jointed, detachable billiard cue wherein the joint or connector components are threaded to their respective cue sections, i.e. cue butt and shaft. Additionally, the components may be adhesively joined to their respective cue sections to provide an axial mechanical force which greatly improves the joint strength and its resistance to the axial shock which is experienced when hitting a ball with relatively hard force. In addition, the present design utilizes a full thread engagement to insure maximum frictional forces lessening the chance of loosening of the two cue halves.

The foregoing is accomplished by providing a detachable, jointed billiard cue with the butt and shaft sections joined by a connector comprised of a joint fitting carried by the butt section and an insert fitting carried by the shaft section. The butt section is provided with a threaded distal end portion of reduced diameter and arranged to threadingly receive the joint fitting. The cylindrical joint fitting includes an enlarged axial portion having an outer diameter substantially the same as the adjoining butt section diameter, and further defining an open-ended cylindrical chamber. The chamber is threaded to receive and to be secured to the threaded distal end portion of the butt section. The joint fitting also includes an integrally formed, axially extending, threaded pin for releasable threading engagement with the insert fitting. The threaded insert fitting is also provided with an externally threaded axial portion for secure engagement with a re-entrant threaded bore of the shaft section of the cue.

Although the connecting components provide excellent threaded sealing engagement with the cue sections, both fittings include a chamber or pocket for receipt of an adhesive bonding agent for additional securement to the respective cue sections.

DESCRIPTION OF THE PREFERRED EMBODIMENT

Figure 1:
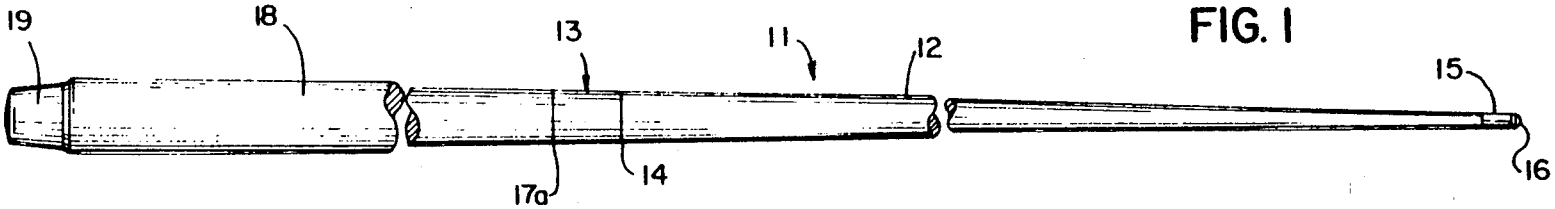
FIG. 1 is a fragmentary elevational view of a billiard cue embodying the present invention and illustrating the butt and shaft cue sections joined together.

Referring to the drawings, and more specifically to FIG. 1, there is illustrated a jointed, detachable billiard or pool cue identified by the general reference 11 and comprising tapered shaft section 12 having a circular cross-section which is largest at facing edge 14 of detachable joining device or connector 13 and gradually decreasing to its smallest dimension at the opposite end. At the opposite end, cue point 15 is provided and supports semi-spherical cue tip 16. The other section of billiard cue 11 comprises tapered butt section 18 having a circular cross-section which is smallest at facing edge **17*a* and gradually increasing to its largest diameter at the opposite end. Bumper 19 is fitted to butt section 18**.

Figure 2:
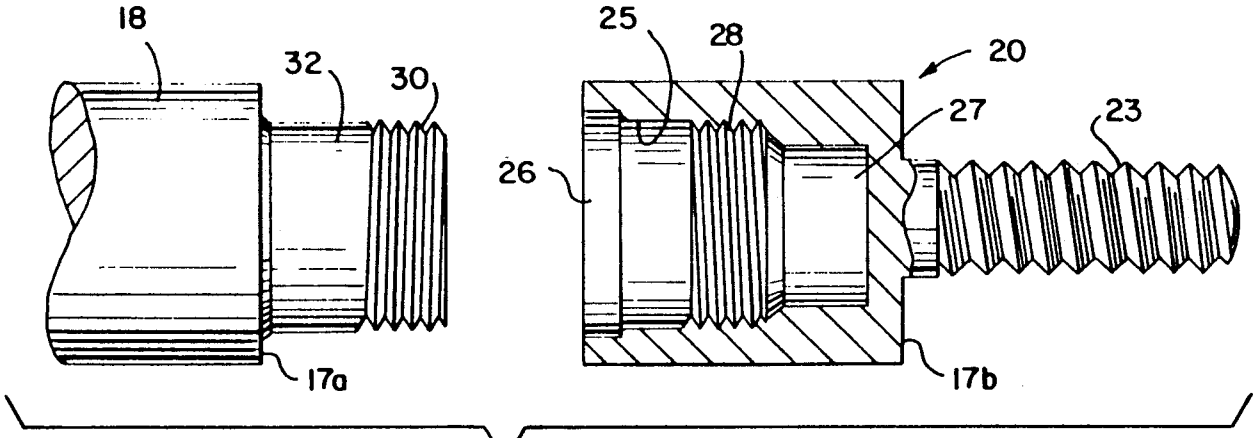
FIG. 2 is an exploded view, partly in longitudinal section, and illustrating the butt section of the cue and the fitting member to be secured thereto.
Figure 3:
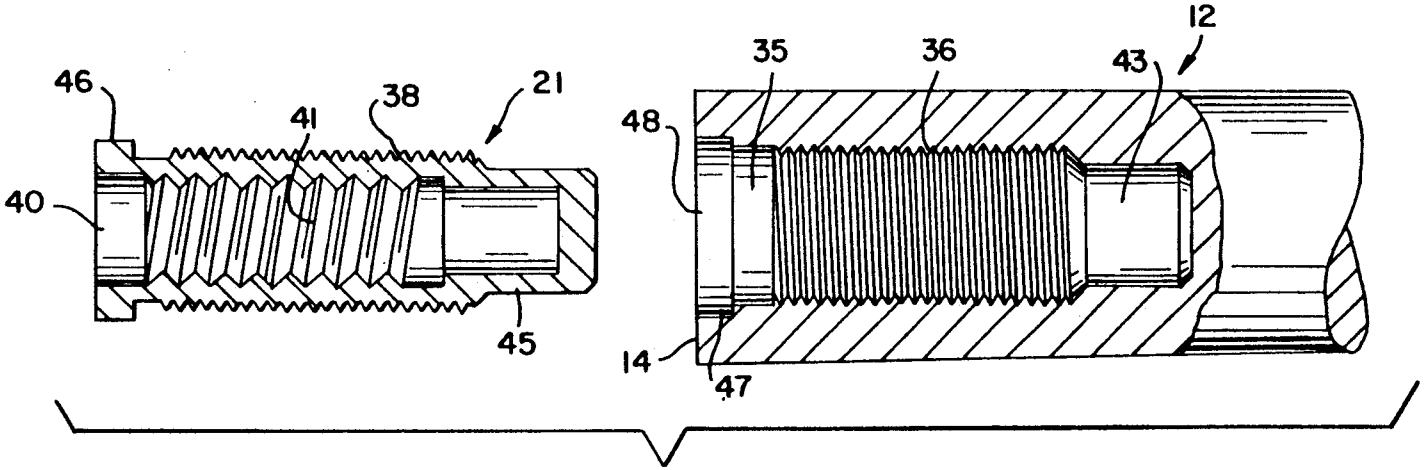
FIG. 3 is an exploded view partly in longitudinal section, and illustrating the shaft section of the cue and the fitting member to be secured thereto.

With reference to FIGS. 2 and 3, it will be observed that detachable joining device or connector 13 comprises machined joint fitting 20 and a machined insert fitting 21. Fitting 20 has an outer diameter tapered consistent with the tapered outer diameters of butt section 18 and shaft section 12 such that when all three pieces are joined together as one, the outer diameter of billiard or pool cue 11 exhibits a smooth, continuous, gradual taper from the wide end of butt section 18 to the narrow end of shaft section 12. Fitting 20 terminates in threaded pin or male portion 23. Fitting 20 includes open-ended, cylindrical chamber 25 having at its open end an entrance portion 26 of slightly enlarged diameter, and inner bore portion 27 of reduced diameter. Intermediate machine threaded portion 28 of chamber 25 is arranged for threaded securement to threaded portion 30 of axially extending end portion 32 of butt section 18. End portion 32 is of reduced diameter and arranged to receive the re-entrant bore or chamber 25 of fitting 20.

Figure 4:
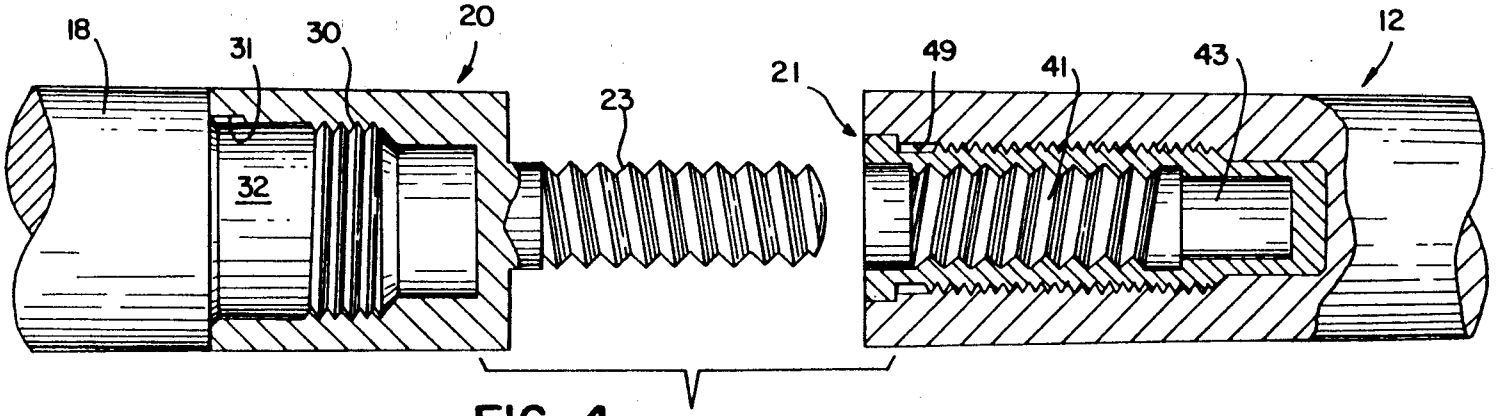
FIG. 4 is a fragmentary elevational view, partially in exploded longitudinal section with the butt and shaft sections having their respective fittings respectively secured thereto, and being separated and axially spaced from one another.

An adhesive bonding compound is preferably deposited at pocket area 31 (see FIG. 4) formed between end portion 32 of butt section 18 and enlarged diameter entrance portion 26 of bore 25 of fitting 20 to provide additional securement of fitting 20 to butt section 18.

With particular reference to the exploded view of FIG. 3, it will be observed that cue shaft section 12 is provided with re-entrant bore 35 having intermediate threaded portion 36 arranged to receive externally threaded portion 38 of insert fitting 21. Fitting 21 is preferably machined from solid brass stock. Insert fitting 21 is also provided with bore 40 having female threaded portion 41 arranged to receive male threaded extension or pin 23 of fitting 20 (see FIG. 2). Threadably engagable portions 23 and 41 are arranged for manual joining and detachment of cue sections 12 and 18, as required for transportation of billiard cue 11.

Figure 5:
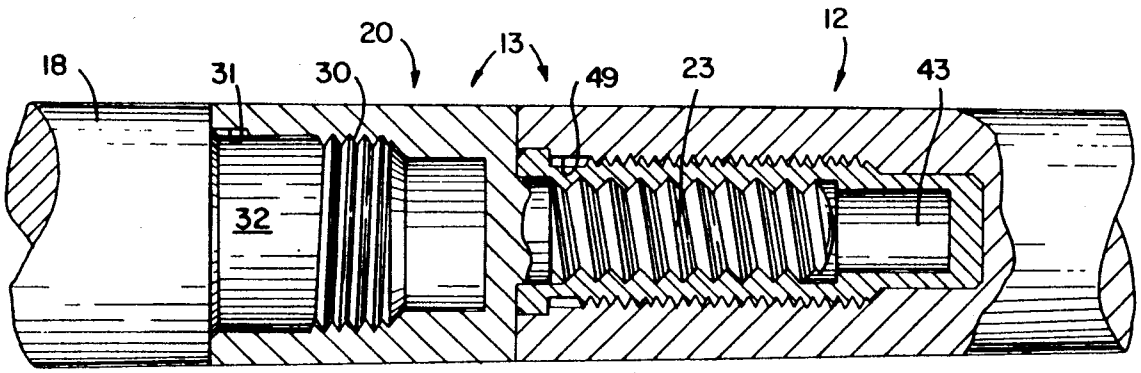
FIG. 5 is an enlarged fragmentary view of a portion of the cue of FIG. 1, and partly in longitudinal section to illustrate the components of the cue and connector components in threading engagement relative to one another.

The diameter of bore 35 of shaft section 12 is reduced at its innermost end portion 43 to receive non-threaded distal end portion 45 of insert fitting 21. At its opposite end, insert fitting 21 includes radially extending flange 46 engagable with shoulder stop 47 formed by enlarged diameter 48 of the bore 35. Insert fitting 21 and shaft section 12 are additionally secured by means of adhesive deposited in pocket area 49 (see FIGS. 4 and 5) formed by the unthreaded areas of bore 35 and insert fitting 21.

Butting engagement of the cue sections is stopped by machined end walls 14 and 17*b* of cue shaft section 12 and fitting 20, respectively.

It will be apparent that the present invention has provided a billiard cue having a detachable shaft and butt section with a one-piece butt joint fitting to provide a solid mass that transmits vibration (feel) to the shooter's hand similar to a solid one-piece wood cue. When coupled together, vibration is transmitted from shaft section 12 through joint fitting 20 to butt section 18. Being that the members are each one-piece, the vibration waves have minimal distortion to the side of the cue and are transmitted longitudinally to the shooter's hand, thereby producing a more solid feel to the person shooting.

Both the stainless steel joint fitting 20 and shaft brass insert fitting 21 are individually machined in one setup to provide precise concentricity of the threads and locating diameters and squareness of the faces of the diameters. This enables the butt section to be fitted with a variety of different shafts that have shaft insert fittings matched to the butt joint fitting.

What is claimed is:

1. A cue connector for a detachable, jointed billiard cue comprising a first and a second section, said connector including a one-piece joint fitting adapted to be carried by the first cue section and a one-piece insert fitting adapted to be carried by the second cue section, the first cue section being provided with an axially extending shaft portion of reduced diameter having a proximal end, a distal end and a threaded portion intermediate the proximal and distal ends of said shaft portion, said one-piece joint fitting having a first enlarged portion defining an open-ended cylindrical chamber, said chamber at least partially defined by a threaded section spaced inwardly from the open end of said chamber and adapted for threading engagement with the threaded portion of the shaft portion of the first cue section, said camber further defined by an inner portion of relatively reduced diameter adapted for receiving the distal end of the first cue section, said joint fitting further including a protruding threaded pin, the second cue section containing an open-ended re-entrant bore for receiving said insert fitting, said bore defined by an internally threaded portion, an enlarged shouldered stop at the open end of said bore and an inner bore portion of reduced diameter, said insert fitting having an externally threaded portion adapted for threading engagement with the threaded portion of said bore of the second cue section, a first end of reduced diameter adapted for seating within said inner reduced bore portion of the second cue section, a outwardly flanged end adapted to engage said shouldered stop formed in said bore of the second cue section, and a re-entrant bore at least partially defined by a threaded portion for detachably receiving the threaded pin of said joint fitting.

2. The cue connector of claim 1, wherein said insert fitting further includes a relieved axial portion located between said outwardly flanged end and said externally threaded portion, said relieved axial portion for reception of an adhesive bonding agent for additional securement of the insert fitting to the second cue section.

3. The cue connector of claim 1, wherein said joint fitting further includes a relieved axial portion located at the entry of the open-ended cylindrical chamber, said relieved axial portion for reception of an adhesive bonding agent for additional securement of the joint fitting to the first cue section.

4. The cue connector of claim 1, wherein said re-entrant bore of said insert fitting includes an unthreaded portion adjacent the threaded portion.

5. The cue connector of claim 4 wherein said threaded pin extending from the joint fitting includes an unthreaded portion adapted for slidable, rotative engagement with the unthreaded portion of the re-entrant bore of said insert fitting, such that when the insert fitting and the joint fitting are engaged, the adjacent unthreaded portions of the fittings provide radial support between said fittings.

6. The cue connector of claim 1, wherein the bore of said insert fitting includes an unthreaded portion at its inner end.

7. The cue connector of claim 1 in combination with a billiard cue.

8. The cue connector of claim 5 in combination with a billiard cue.

* * * * *